United States Patent [19]

Porowski et al.

[11] Patent Number: 4,842,655

[45] **Date of Patent: * Jun. 27, 1989**

[54] PROCESS FOR IMPROVING RESISTANCE OF METAL BODIES TO STRESS CORROSION CRACKING

[75] Inventors: Jan S. Porowski; Manu L. Badlani; William J. O'Donnell, all of Pittsburgh; Edward J. Hampton, Murrysville, all of Pa.

[73] Assignee: O'Donnell & Associates, Inc., Pittsburgh, Pa.

[ * ] Notice: The portion of the term of this patent subsequent to Oct. 27, 2004 has been disclaimed.

[21] Appl. No.: 156,529

[22] Filed: Feb. 16, 1988

[51] Int. Cl.[4] ..... C21D 9/14; C21D 9/08

[52] U.S. Cl. ..... 148/130; 148/135; 376/305; 376/900

[58] Field of Search ..... 148/13, 130, 134, 135; 376/305, 900

[56] References Cited

U.S. PATENT DOCUMENTS

| | | | |
|---|---|---|---|
| 3,770,256 | 11/1973 | Godin et al. | 148/130 |
| 4,512,820 | 4/1985 | Mori et al. | 148/12.7 N |
| 4,659,398 | 4/1987 | Heller et al. | 148/134 |
| 4,699,671 | 10/1987 | Jacobs et al. | 148/13 |
| 4,702,880 | 10/1987 | Porowski et al. | 148/130 |

*Primary Examiner*—Robert McDowell

*Attorney, Agent, or Firm*—Joseph J. Carducci

[57] ABSTRACT

A process for improving resistance of pressure vessel shells, tubesheets, tubes, pipes, pipe fittings and machine parts to stress corrosion cracking comprising heating at least those portions of such bodies subject to danger by stress corrosion cracking to a critical elevated thermperature level, cooling at least the surface portions of the metal body subject to stress corrosion cracking and then permitting such treated portions of the metal body to come to ambient temperature.

18 Claims, 3 Drawing Sheets

TEMPERATURE TIME DIAGRAM

PROCESS FOR IMPROVING RESISTANCE OF METAL BODIES TO STRESS CORROSION CRACKING

BACKGROUND OF THE INVENTION

1. Field of the Invention

This invention relates to a process for improving resistance of pressure vessel shells, tubesheets, tubes, pipes, pipe fittings and machine parts to stress corrosion cracking which comprises heating at least those portions of the pressure vessel shell, tubesheet, tube, pipe, pipe fitting and machine part subject to danger by stress corrosion cracking to a critical elevated temperature level, cooling at least the surfaces of those portions of said pressure vessel shell, tubesheet, tube, pipe, pipe fitting and machine part subject to stress corrosion cracking and then permitting said cooled surface portions to come to ambient temperature.

2. Description of the Prior Art

In our U.S. Pat. No. 4,702,880, issued Oct. 27, 1987, we discovered, and claimed, a process for improving resistance of control rod guide tube split pins in nuclear reactors to stress corrosion cracking which comprised heating said split pin to a critical elevated temperature level, cooling at least the surface portions of said split pin subject to stress corrosion cracking and then permitting said split pin to come to ambient temperature.

We have now further found that the process claimed in our U.S. Pat. No. 4,702,880 can also be used to improve resistance of pressure vessel shells, tubesheets, tubes, pipes, pipe fittings and machine parts to stress corrosion cracking when the same are placed or are used in surroundings tending to induce stress corrosion cracking therein or in a portion thereof. When pressure vessel shells, tubesheets, tubes, pipes, pipe fittings and machine parts are produced and/or are assembled high tensile residual stresses occur over their entire surfaces or over a portion thereof. Often in use these elements are in a hostile environment, for example, in situations wherein they are in contact with water under high pressure, often with the water containing dissolved oxygen and/or chemicals. Under these circumstances these elements are subject to stress corrosion cracking, particularly when they are made, in whole or in part, of stainless steel or high nickel alloys. When this happens, failure occurs, often with catastrophic results and with great loss in money.

SUMMARY OF THE INVENTION

We have now found that we can greatly improve resistance of pressure vessel shells, tubesheets, tubes, pipes, pipe fittings and machine parts to stress corrosion cracking using a process which comprises heating at least those portions of said pressure vessel shell, tubesheet, tube, pipe, pipe fitting and machine part subject to danger by stress corrosion cracking to an elevated temperature level, cooling at least the surfaces of said pressure vessel shell, tubesheet, tube, pipe, pipe fitting or machine part subject to stress corrosion cracking below said elevated temperature level and then permitting said cooled surfaces to come to ambient temperature, said elevated temperature level being below the chaacteristic temperature resulting in metallurgical change in the material of said pressure vessel shell, tubesheet, tube, pipe, pipe fitting and machine part subject to stress corrosion cracking but at least an elevated temperature level such the difference between said elevated temperature level and the temperature to which such surfaces are initially cooled is sufficient to result in plastic flow of said initially cooled surface to a depth equivalent to at least one grain size.

DESCRIPTION OF THE PROCESS

Figure 1:
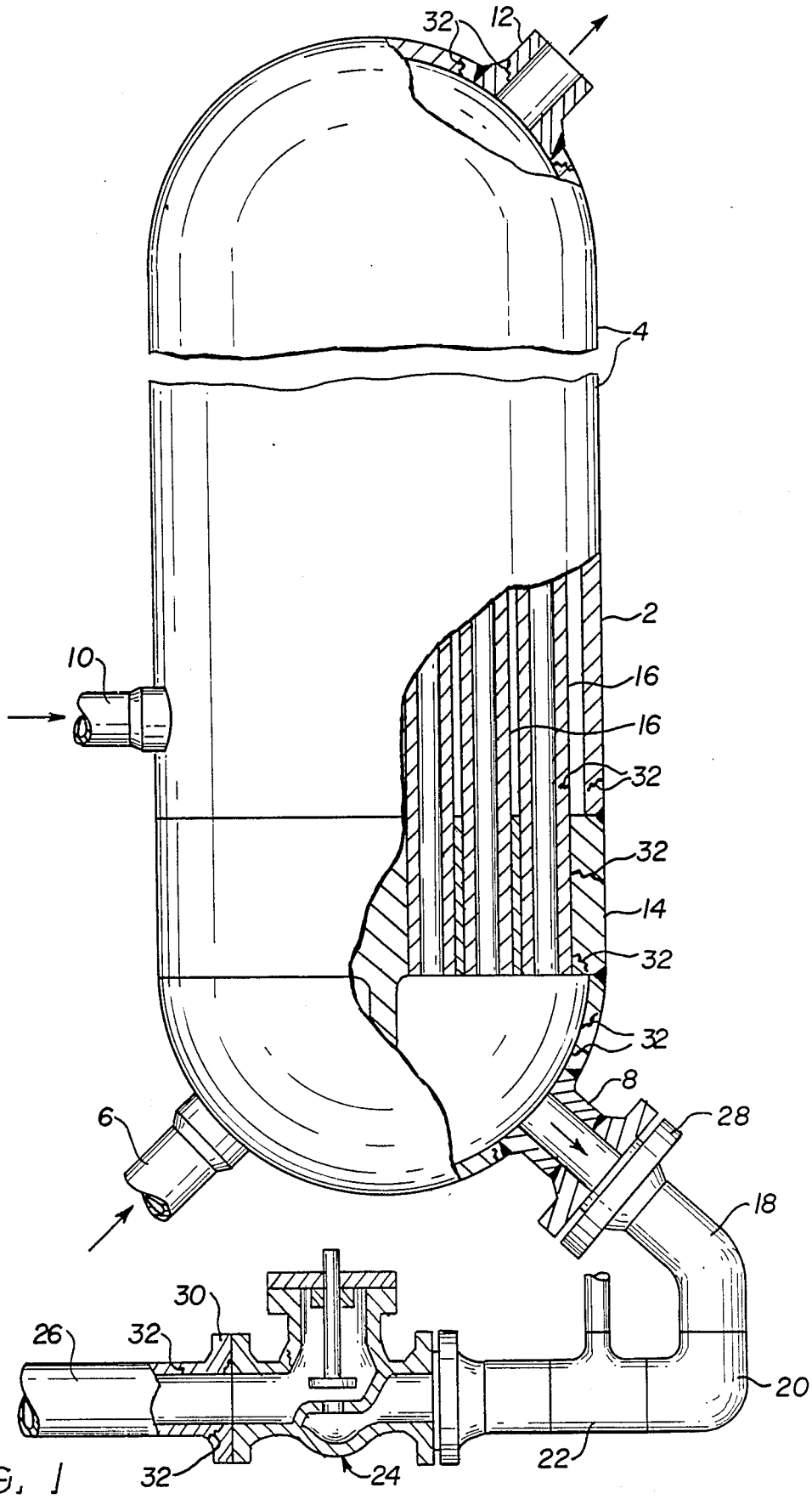
FIG. 1 is an elevational view, partly in section, of a steam generator illustrating the portions thereof wherein improvement in the resistance to stress corrosion cracking can be made.

Referring to FIG. 1, reference numeral 2 refers to a shell of a steam generator 4 in which there is located a hot water inlet 6, a cold water outlet 8, a feedwater inlet 10, a steam outlet 12 and a tubesheet 14 in which there are disposed a number of tubes 16. Cold water from cold water outlet 8 flows sequentially through pipe 18, elbow 20, tee 22 valve means 24 and then through pipe 26. Cold water outlet 8 is joined to pipe 18 by means of flange 28 and valve means 24 to pipe 26 by flange 30. Shown in FIG. 1 are a number of cracks 32 that can develop in the apparatus of FIG. 1 because of stress corrosion.

Figure 2:
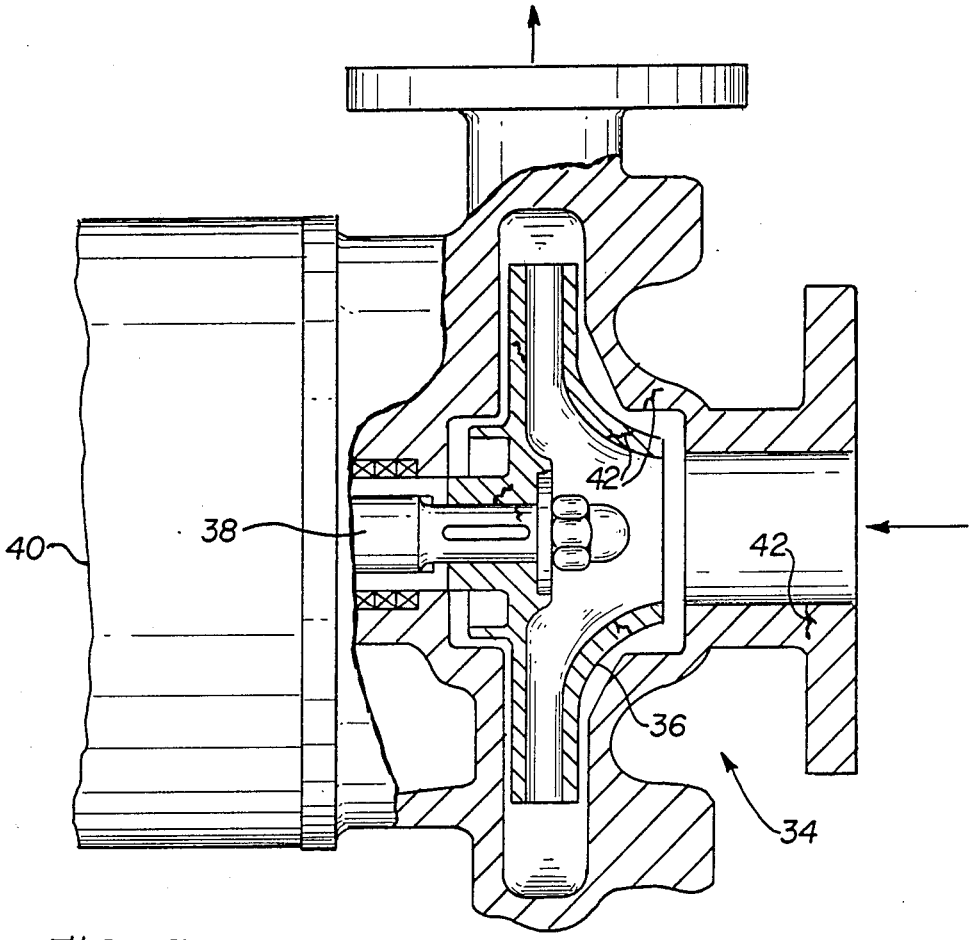
FIG. 2 is an elevational view, partly in section, of a machine illustrating the portions thereof wherein improvement in the resistance to stress corrosion cracking can be made.

Referring to FIG. 2, there is shown a pump 34 as an exemplification of a machine wherein stress corrosion cracking can occur. The flow of water through the pump is achieved by the rotation of rotor 36 assembled on shaft 38 attached to drive means 40. Shown in FIG. 2 are a number of cracks 42 that can develop in pump 34 as a result of stress corrosion.

Figure 3:
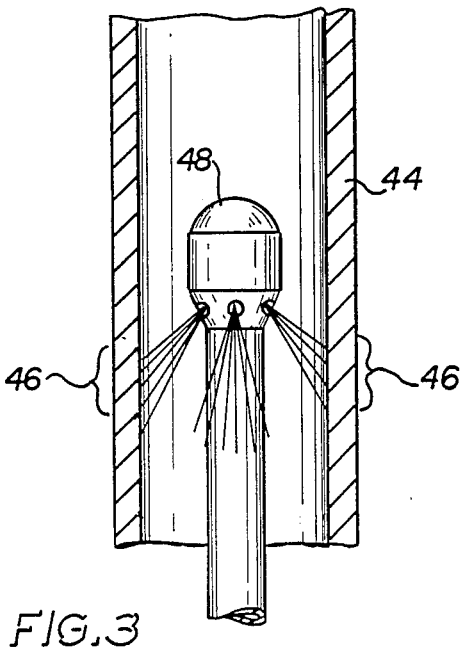
FIG. 3 is an elevational view, partly in section, illustrating a procedure wherein a tube, after being heated, is cooled in accordance with the invention defined and claimed herein.

As an exemplification of the process defined herein, FIG. 3 illustrates a preferred procedure for cooling a tube, which has been heated in a portion thereof endangered by stress corrosion cracking to improve its resistance to such cracking. Shown therein is a tube 44 which has been heated in at least portions 46 thereof and a spray nozzle 48 internally positioned directing a spray of cold liquid, such a water, on said portions 46.

According to our invention, we remove tensile stresses and generate compressive stresses in the surface layers of those portions of pressure vessel shells, tubesheets, tubes, pipes, pipe fittings and machine parts subject to stress corrosion cracking prior to their exposure to a corrosive environment, thus eliminating, or substantially reducing, their tendency to crack initiation or growth. This is done by heating at least those portions of the pressure vessel shell, tubesheet, tube, pipe, pipe fitting or machine part to a critical temperature level and then cooling at least the surface of those portions of the pressure vessel shell, tubesheet, tube, pipe, pipe fitting or machine part under high tensile stress such that the material at those surface portions flows plastically in tension. Then when such surfaces are brought back to ambient temperature, the residual tensile stresses have been removed and the surface material so treated remains under compression. When the above articles have been so treated, they can safely be used in the environment described above without fear of crack initiation or growth and ultimate failure.

The first step in our process involves heating the pressure vessel shell, tubesheet, tube, pipe, pipe fitting or machine part to an elevated temperature level, preferably throughout its bulk, but below the characteristic temperature resulting in metallurgical change in the material of the articles named above. Of course, when the element is large, for example in the case of the pressure vessel shell, only those portions of said body need be treated that are subject to stress cracking in use. The elevated temperature to which said article is heated must, however, be sufficiently high such that the difference between said elevated temperature level and the temperature to which a surface thereof is initially cooled in the subsequent step is sufficient to result in plastic flow of said initially cooled surface to a depth equivalent to at least one grain size. The elevated temperature to which said above-named articles are heated will depend on a number of variables, such as the composition thereof, the depth to which plastic flow is desired after the article is cooled, etc. In general, the temperature level to which the article is heated will lie in the range of about 400° F. to about 1300° F. Thus, if the article is composed in the portion thereof being treated, of Inconel, the elevated temperature can be in the range of about 800° F. to about 1300° F., preferably about 900° F. to about 1200° F. When stainless steel is being treated, the elevated temperature can be in the range of about 400° F. to about 1200° F., preferably from about 600° to about 1000° F., and with carbon steel from about 400° to about 1200° F., preferably from about 600° to about 800° F.

In the second step, the article, namely, the pressure vessel shell, the tubesheet, tube, pipe, pipe fitting or machine part, after being heated to the temperature level defined above, is surface cooled at those portions thereof that are under high tensile stress, or will be under high tensile stress in use, to a lower temperature level, such that the difference between the elevated temperature, defined above, and the temperature which the surface is cooled in this second step is sufficient to result in plastic flow of the cooled surface to a depth equivalent to at least one grain size. The entire surface of the defined article can be cooled, if desired, but in the preferred embodiment only those portions of the article that are endangered by stress corrosion cracking are subjected to cooling. To cool the desired surfaces, as defined above, any suitable procedure can be used, for example, spraying with a liquid, such as water, mineral oil, etc. or immersing the entire article, when feasible, in a cooling liquid, such as water, mineral oil, etc. In a preferred embodiment, cooling is carried out by spraying only those portons of the defined article endangered by stress corrosion cracking with water using spray nozzles. The temperature to which the selected surface of the article is cooled will also depend on many factors, such as the composition of said article, the depth of plastic flow desired on the surface thereof, etc. In general, the surface of said article that is cooled will be in the range of about ambient temperature (68° F.) to about 400° F., but more often between about ambient temperature and about 212° F. Cooling of said surface is continued until plastic flow is obtained in the surface thereof extending to a depth equivalent to at least one grain size, preferable in the range of about two to about 50 grain sizes of the material of which said article is composed, provided that the plastic layer does not extend beyond about 10 percent of the distance to an adjacent outer surface. Thus, the step of cooling said heated surfaces is within about one second to about one minute, but generally cooling can be terminated within about 3 to about 30 seconds. it is critical that the above considerations be strictly adhered to otherwise a deeper plastic surface layer will result, causing undesired rise of stresses in the adjacent central portions of the bulk material of the body so treated.

In the third step of the process, the cooling procedure used in the second step is terminated and the body so treated is permitted, by any suitable means, to come to ambient temperature, at which time the residual tensile stresses defined above are removed in the treated body and the surface material will be in compression. The treated body can be safely used in the intended environment without fear of initiating cracks in the critical portions thereof.

Figure 4:
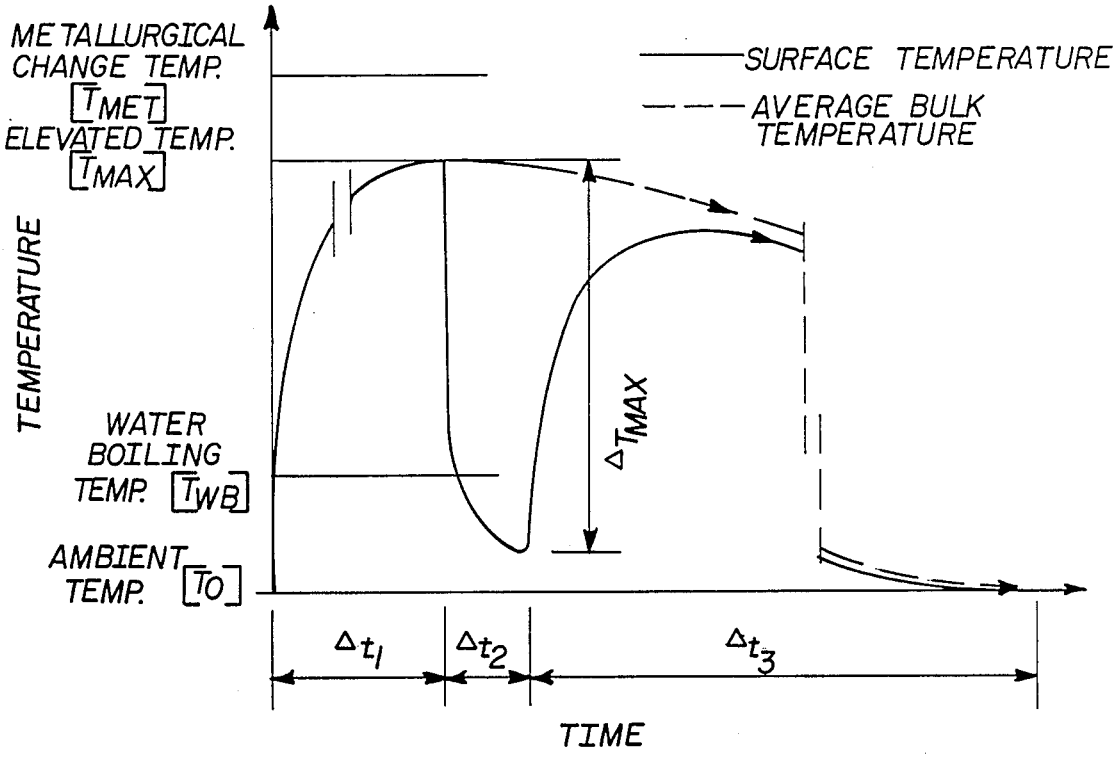
FIG. 4 is a temperature-time diagram of the process defined and claimed herein.

The temperature profile of the above-defined body, so treated, during the claimed operation herein can be seen from FIG. 4, for example, when water is sprayed on the surface of the body during the defined cooling procedure. During the time period $\Delta t_1$, the bulk material, or the portion thereof subject to stress corrosion cracking, is heated to an elevated temperature level but below the temperature resulting in metallurgical change in the material of said body. At the beginning of time interval $\Delta t_2$, water is sprayed onto the heated surface of the body being treated and the surface temperature quickly falls below the boiling point of water but the temperature in the adjacent bulk of the body is little affected by the reduction in temperature of the cooled surface. When the cooling is terminated at the end of the interval $\Delta t_2$, the temperature of the surface quickly rises to approach the slowly falling temperature of the adjacent bulk of the body being treated, and then each of the temperatures, surface and bulk, slowly falls to the same temperature level at the end of the interval $\Delta t_3$.

DESCRIPTION OF THE PREFERRED EMBODIMENT

A seamless tube having an outer diameter of 0.75 inch and a thickness of 0.0625 inch, composed on Iconel 600, is heated throughout its bulk, over a period of five minutes, to a temperature of 900° F. and then cooled over a period of 0.5 second until its surface temperatures are about 212° F. by spraying thereon water that is at ambient temperature (68° F.). The temperature level of the surfaces is maintained at such level for a total of 1.5 seconds by continued water spraying. Spraying is then terminated and the surfaces then rise substantially to the temperature of the bulk over a period of about 5 seconds. The tube so treated is then cooled in air over a period of about 15 minutes, at which time the total bulk of the tube is at approximately ambient temperature. The material on the cooled surfaces will have flowed plastically during the above treatment, and the tendency of the tube to stress corrosion cracking will have been substantially reduced.

For purposes of this invention, "metallurgical change" is defined as phase change transformation wherein metal changes from one crystal structure to another or by a notable increase in grain size. Phase diagrams are available in the literature. For example, a phase diagram for Iron-Carbon is shown in *Elements of Physical Metallurgy* by Albert G. Guy, Addison-Wesley Publishing Company, Inc. Reading, Mass., 1951, page 92. By "grain," we mean a portion of a metal or a metal alloy having a single orientation of space lattice. Grain therefore is a metal crystal with more or less irregular boundaries. By "stress corrosion cracking," we refer to intergranular or transgranular attack of steel subjected to tensile stress in a hostile environment, such as boiler feedwater.

Obviously, many modifications and variations of the invention, as defined herein, can be made without departing from the spirit and scope thereof, and, therefore, only such limitations should be imposed as are indicated in the appended claims.

We claim:

1. A process for improving resistance of a metal body selected from the group consisting of pressure vessel shells, tubesheets, pipes and pipe fittings to stress corrosion cracking which comprises heating at least those portions of said metal body endangered by stress corrosion cracking to an elevated temperature level, cooling at least the surfaces of those heated portions of said metal body endangered by stress corrosion cracking to a temperature below said elevated temperature, and then permitting said portions of said metal body to come to ambient temperature, said elevated temperature level being below the characteristic temperature resulting in metallurgical change in the material of said metal body but at least an elevated temperature level such that the difference between said elevated temperature level and the temperature to which said surfaces are cooled is sufficient to result in plastic flow of said cooled surfaces to a depth equivalent to at least one grain size.

2. The process of claim 1 wherein said metal body is a pressure vessel shell.

3. The process of claim 1 wherein said metal body is a tubesheet.

4. The process of claim 1 wherein said metal body is a pipe fitting.

5. The process of claim 1 wherein said elevated temperature is in the range of about 400° F. to about 1300° F.

6. The process of claim 1 wherein said portions of said metal body are composed of stainless steel and said elevated temperature is in the range of about 400° F. to about 1200° F.

7. The process of claim 1 wherein said portions of said metal body are composed of stainless steel and said elevated temperature is in the range of about 600° F. to about 1000° F.

8. The process of claim 1 wherein said portions of said metal body are composed of carbon steel and said elevated temperature is in the range of about 400° F. to about 1200° F.

9. The process of claim 1 wherein said portions of said metal body are composed of carbon steel and said elevated temperature is in the range of about 600° F. to about 800° F.

10. The process of claim 1 wherein said surfaces of said heated metal body are cooled to a temperature ranging from about ambient temperature to about 400° F.

11. The process of claim 1 wherein said surfaces of said heated metal body are cooled to a temperature ranging from about ambient temperature to about 212° F.

12. The process of claim 1 wherein said cooling is terminated within about one second to about one minute.

13. The process of claim 1 wherein said cooling is terminated within about three to about 30 seconds.

14. The process of claim 1 wherein the difference between said elevated temperature and the temperature to which said surfaces are cooled is sufficient to result in plastic flow of said surface to a depth equivalent of about two to about 50 grain sizes.

15. The process of claim 1 wherein said cooling of said surfaces is obtained by spraying a liquid thereon.

16. The process of claim 15 wherein said liquid is water.

17. The process of claim 1 wherein said portions of said metal body are heated to a temperature in the range of about 400° F. to about 1,300° F., said surfaces are cooled to a temperature ranging from about ambient temperature to about 400° F. by spraying a liquid thereon, terminating said spraying, whereby the temperature of said surfaces increases to approach the temperature of the bulk of said metal body, and then permitting said metal body to come to ambient temperature, so that the depth of said plastic flow is in the depth equivalent range of about 2 to about 50 grains.

18. The process of claim 17 wherein said portions of said metal body are heated to a temperature in the range of about 600° F. to about 1,200° F. and said surfaces are cooled to a temperature ranging from about ambient temperature to about 212° F.

* * * * *